US009206541B2

(12) United States Patent
Doh

(10) Patent No.: US 9,206,541 B2
(45) Date of Patent: Dec. 8, 2015

(54) LAUNDRY PROCESSING DEVICE

(75) Inventor: Young Jin Doh, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1168 days.

(21) Appl. No.: 13/129,683

(22) PCT Filed: Nov. 17, 2009

(86) PCT No.: PCT/KR2009/006742

§ 371 (c)(1),
(2), (4) Date: Aug. 8, 2011

(87) PCT Pub. No.: WO2010/056084

PCT Pub. Date: May 20, 2010

(65) Prior Publication Data

US 2011/0283747 A1 Nov. 24, 2011

(30) Foreign Application Priority Data

Nov. 17, 2008 (KR) ..... 10-2008-0114179

(51) Int. Cl.
*D06F 39/02* (2006.01)
*D06F 39/08* (2006.01)

(52) U.S. Cl.
CPC ..... *D06F 39/02* (2013.01); *D06F 39/028* (2013.01); *D06F 39/088* (2013.01)

(58) Field of Classification Search
CPC ..... D06F 39/02; D06F 39/028; D06F 39/088
USPC ..... 68/17 R, 207
See application file for complete search history.

(56) References Cited

U.S. PATENT DOCUMENTS

| | | | | |
|---|---|---|---|---|
| 3,757,543 | A * | 9/1973 | Braga | 68/17 R |
| 2005/0274155 | A1* | 12/2005 | Namkung et al. | 68/17 R |
| 2005/0284194 | A1* | 12/2005 | Kim et al. | 68/17 R |

FOREIGN PATENT DOCUMENTS

| | | |
|---|---|---|
| CN | 1715525 A | 1/2006 |
| DE | 1 610 199 | 3/1972 |

(Continued)

OTHER PUBLICATIONS

Machine translation of KR 10-2005-0047424 A, May 2005.*

(Continued)

*Primary Examiner* — Joseph L Perrin
(74) *Attorney, Agent, or Firm* — Ked & Associates, LLP

(57) ABSTRACT

The present invention aims to provide a laundry processing device wherein detergent is supplied by means of the washing water. The present invention provides a laundry processing device comprising: a detergent box having a detergent storage unit which accommodates a detergent and which has an opening part; a washing-water supply device for supplying the detergent storage unit with washing water from the outside; and a regulating unit for closing the opening part of the detergent storage unit in which the detergent is accommodated, and opening the opening part by means of the washing water supplied by the washing-water supply device.

18 Claims, 6 Drawing Sheets

(56) References Cited

FOREIGN PATENT DOCUMENTS

| | | | | | |
|---|---|---|---|---|---|
| DE | 1610199 | A1 | * | 3/1972 | |
| EP | 0582092 | A1 | * | 2/1994 | |
| EP | 1424428 | A2 | * | 6/2004 | ..... D06F 39/02 |
| GB | 2187763 | A | * | 9/1987 | ..... D06F 39/02 |
| JP | 50-028571 | U | | 4/1975 | |
| JP | 50-039067 | U | | 4/1975 | |
| JP | 03-095890 | U | | 9/1991 | |
| JP | 2002-267034 | A | | 9/2002 | |
| KR | 20-1992-002672 | U | | 2/1992 | |
| KR | 10-2005-0047424 | A | | 5/2005 | |

OTHER PUBLICATIONS

Machine translation of DE 1610199A1, no date.*

PCT International Search Report dated Aug. 2, 2010 issued in Application No. PCT/KR2009/006742.

Korean Decision to Grant a Patent dated Feb. 22, 2011 issued in Application No. 10-2008-0114179.

Chinese Office Action dated Oct. 9, 2012 issued in Application No. 200980154627.X.

European Office Action issued in Application No. 09 826 316.3 dated Jul. 24, 2015.

* cited by examiner

LAUNDRY PROCESSING DEVICE

CROSS-REFERENCE TO RELATED PATENT APPLICATIONS

This application is a U.S. National Stage Application under 35 U.S.C. §371 of PCT Application No. PCT/KR2009/006742, filed Nov. 17, 2009, which claims priority to Korean Patent Application No. 10-2008-0114179, filed Nov. 17, 2008.

BACKGROUND OF THE INVENTION

1. Field of the Invention

The present invention relates to a laundry processing device, and more particularly, to a laundry processing device including a regulating unit for opening and closing an opening part.

2. Description of the Related Art

In general, a laundry processing device refers to an apparatus for washing or drying laundry. The laundry processing device uses liquid detergent or powdered detergent when doing laundry. When using the liquid detergent, the user attaches a separate container to a detergent box and stores the liquid detergent therein. The stored liquid detergent is dissolved in washing water introduced from the outside, and supplied to a drum and a tub. However, the user has to use the container every time the user wishes to use the liquid detergent. Also, the user needs to detach the container from the detergent box to keep the container in other places after using the liquid detergent.

SUMMARY OF THE INVENTION

Technical Problem

The present invention aims to provide a laundry processing device wherein detergent is supplied by means of the pressure of the washing water.

Technical Solution

The present invention provides a laundry processing device including: a detergent box having a detergent storage unit which accommodates a detergent and which has an opening part; a washing water supply device for supplying the detergent storage unit with washing water from the outside; and a regulating unit for closing the opening part of the detergent storage unit in which the detergent is accommodated, and opening the opening part by means of the washing water supplied by the washing-water supply device.

The present invention has the advantage of supplying either liquid detergent or powdered detergent by including a regulating unit for opening and closing an opening part. Accordingly, the user can use the liquid detergent without attaching a separate container to a detergent box.

DETAILED DESCRIPTION OF THE INVENTION

Figure 1:
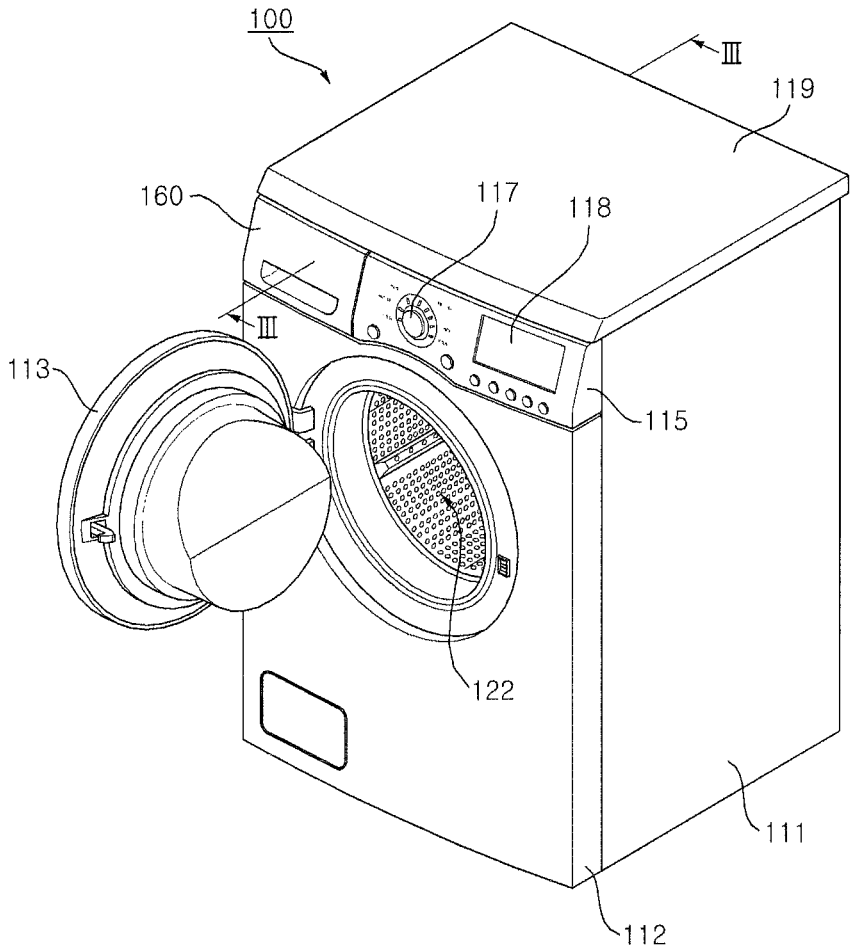
FIG. 1 is a perspective view showing one embodiment of a laundry processing device according to the present invention.

FIG. 1 is a perspective view showing one embodiment of a laundry processing device 100 according to the present invention.

Referring to FIG. 1, the laundry processing device 100 includes a cabinet 110, a tub (not shown) arranged in the cabinet 110 to store washing water introduced from an external source, a drum 122 arranged in the tub to perform laundry washing, a drive device (not shown) to transmit driving force so as to perform laundry washing, a washing-water supply device (not shown) to supply the washing water outside the cabinet 110 to the tub, a washing water draining device (not shown) to drain out the washing water stored in the tub, and a detergent box assembly (not shown) to spray the washing water introduced from the outside and mix the washing water with detergent and an additive and store the mixture.

The cabinet 110 includes a cabinet body 111, a cover 112 arranged on the front side of the cabinet body 111 and attached thereto, a control panel 115 arranged on one side of the cover 112 and connected to the cabinet body 111, and a top plate 119 disposed on an upper side of the control panel 115 and coupled to an upper side of the cabinet body 111. The cabinet cover 112 includes a laundry inlet hole (not indicated) for inserting the laundry into a drum 122, and a door 113 rotatably coupled to the cabinet cover 112 so that it opens and closes the laundry input/outlet opening. The control panel 115 includes a display 118 for providing information of the laundry processing device 100 to a user on the outside, an input unit 117 for receiving an external command signal from the user so as to control the laundry processing device 100, and a detergent box insert hole (not indicated) formed at one side of the control panel 115 to fit the detergent box 160 therein. The detergent box assembly (not shown) includes a washing water spraying device (not shown) for spraying washing water introduced from the outside to the detergent box 160 and a detergent box 160 for storing the sprayed washing water.

The operation of the laundry processing device 100 will be discussed. The user applies power to the laundry processing device 100. After applying power, the user inserts either liquid detergent or solid detergent into the detergent box 160. Once either the liquid detergent or the solid detergent is inserted, washing water is introduced from the outside and mixed with either the liquid detergent or the solid detergent. The mixed washing water flows to the drum 122 and the tub, and is mixed with laundry by the rotation of the drum 122. When laundry washing using the rotation of the drum 122 is completed, the washing water is discharged out by the washing water draining device. Once the washing water is discharged, washing water containing neither the liquid detergent nor the solid detergent is supplied from the outside to rinse the laundry, and the laundry is dewatered.

Figure 2:
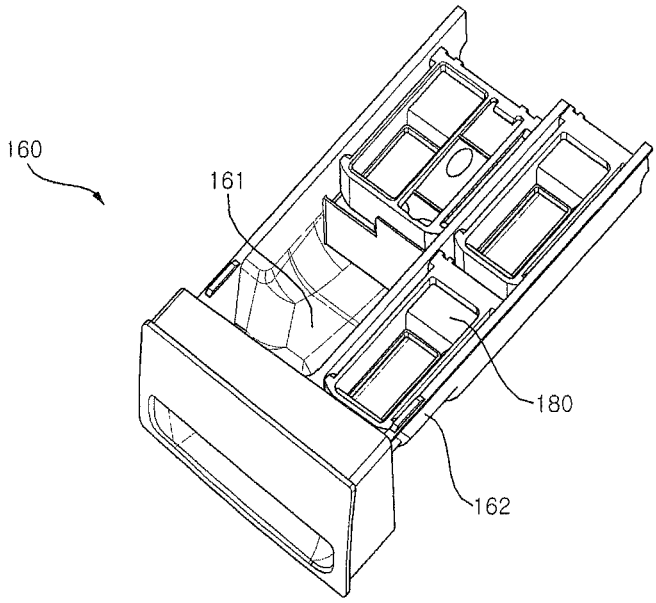
FIG. 2 is a perspective view showing one embodiment of a detergent box shown in FIG. 1.
Figure 3:
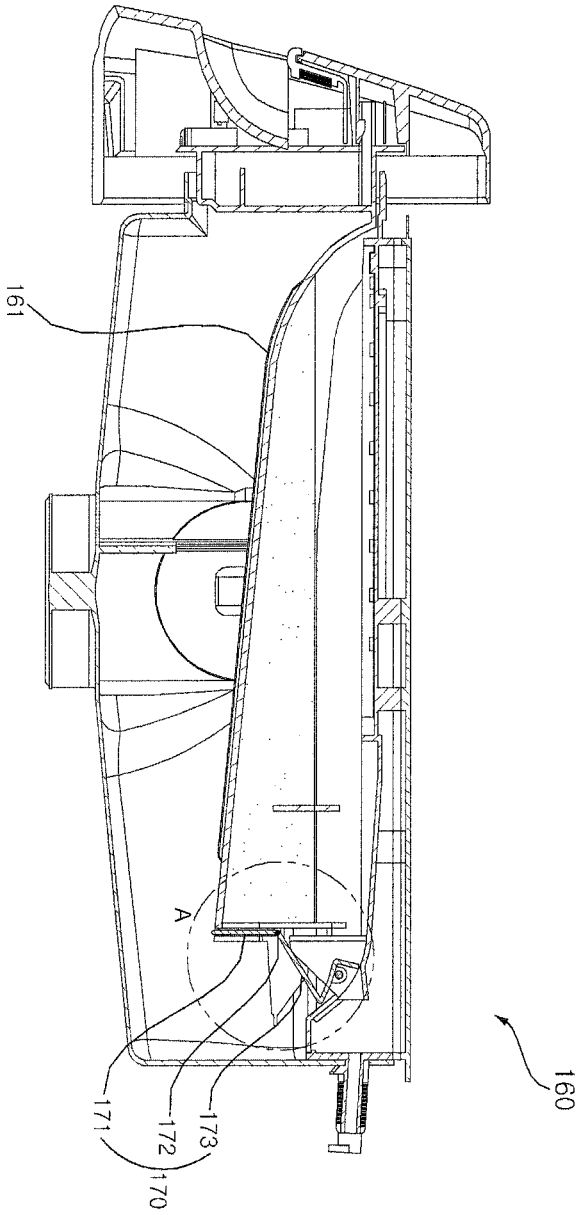
FIG. 3 is a cross-sectional view taken along line of FIG. 2.

FIG. 2 is a perspective view showing one embodiment of a detergent box 160 shown in FIG. 1. FIG. 3 is a cross-sectional view taken along line of FIG. 2.

Referring to FIGS. 2 and 3, the detergent box 160 includes a detergent storage unit or well 161 for storing detergent and an additive storage unit or well 162 formed at one side of the detergent storage unit 161, and for storing an additive. The detergent box 160 includes an opening part (not indicated) at one side of the detergent storage unit 161. A regulating unit or regulator 170 is included which is attached to one side of the opening part and opens and closes the opening part. The regulating unit 170 includes a body portion or plate 171 for opening and closing the opening part, an attachment portion 172 formed at one side of the body portion 171, and for attaching the detergent box 160 and the body portion 171, and a load portion 173 biased from the body portion 171, and for applying force to cause the body portion to close the opening part.

The operation of the laundry processing device 100 will be discussed. The user applies power to the laundry processing device 100 and inserts the liquid detergent or the powdered detergent into the detergent box 160. If the user inserts the liquid detergent, the liquid detergent is stored in the detergent storage unit 161. Once the liquid detergent is stored in the detergent storage unit 161, the liquid detergent remains in the detergent storage unit 161 by means of regulating unit 170. Even if the liquid detergent stored in the detergent storage unit 161 applies a pressure to the regulating unit 170, the load portion 173 applies force so that the body portion 171 closes the opening part of the detergent storage unit 161. As a result, the liquid detergent remains stored in the detergent storage unit 161.

After the liquid detergent is stored in the detergent storage unit 161, the washing water supply device supplies the washing water from the outside. Once the washing water is supplied, the washing water enters the detergent box 160 and flows to the detergent storage unit 161. If the water level of the washing water in the detergent storage unit 161 is higher than a predetermined water level, a pressure is applied to the regulating unit 170. If the pressure becomes stronger than the force applied from the load portion 173, the regulating unit 170 is opened. Once the regulating unit 170 is opened, the washing water flows to the drum 122 and the tub.

When the user inserts the powdered detergent into the detergent storage unit 161, the regulating unit 170 prevents the powdered detergent from flowing out. The regulating unit 170 is prevented from being opened due to the powdered detergent. After the user inserts the powdered detergent, when washing water is supplied from the outside, the regulating unit 170 is opened in the same or similar manner as described above. Accordingly, the powdered detergent is mixed with the washing water and flows to the drum 122 and the tub.

Figure 4:
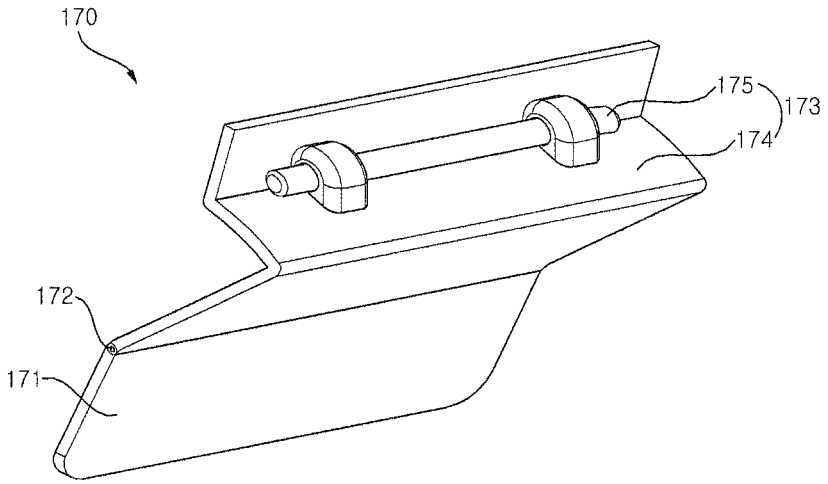
FIG. 4 is a perspective view showing one embodiment of a regulating unit shown in FIG. 3.
Figure 5:
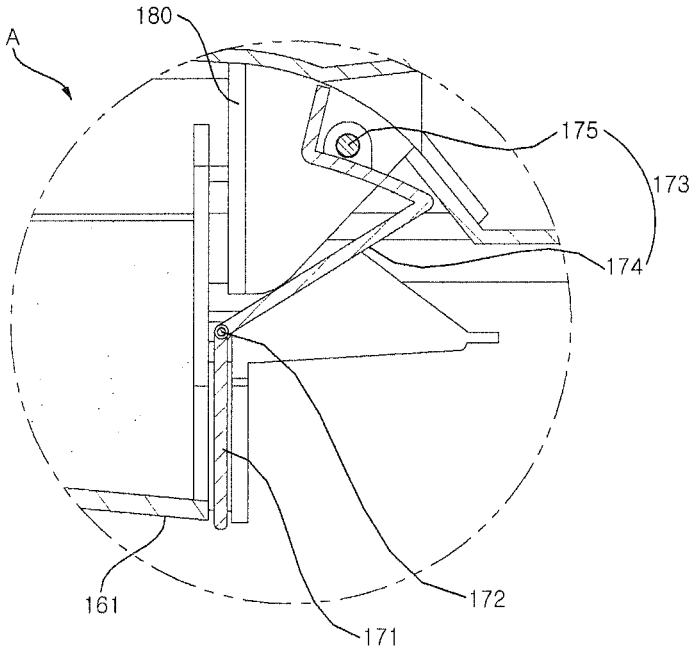
FIG. 5 is a cross-sectional view showing when the regulating unit shown in FIG. 4 closes an opening part.
Figure 6:
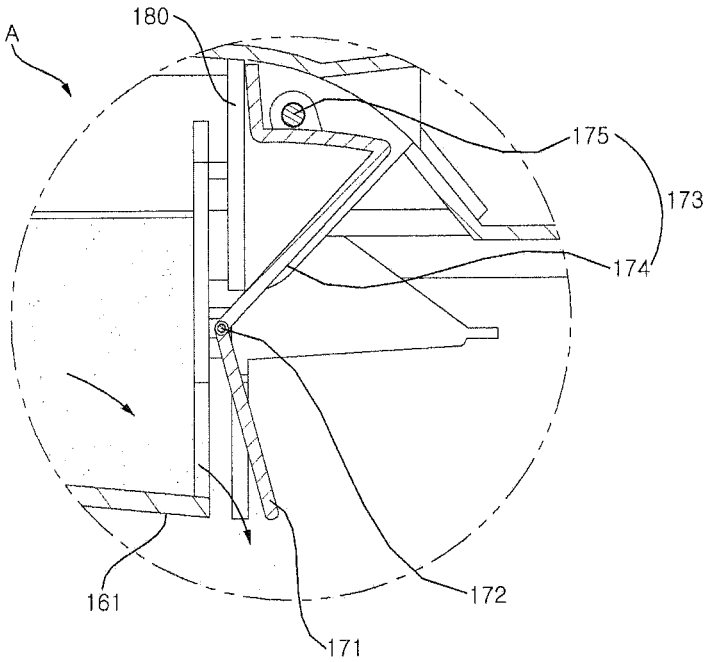
FIG. 6 is a cross-sectional view showing when the regulating unit shown in FIG. 4 opens the opening part.
Figure 7:
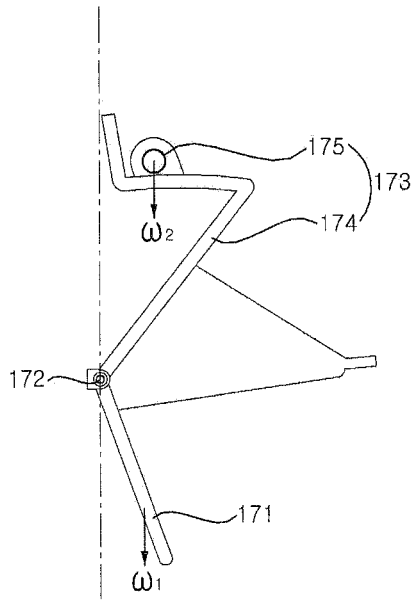
FIG. 7 is a conceptual view showing the load of the regulating unit shown in FIG. 4.

FIG. 4 is a perspective view showing one embodiment of a regulating unit 170 shown in FIG. 3. FIG. 5 is a cross-sectional view showing when the regulating unit 170 shown in FIG. 4 closes an opening part. FIG. 6 is a cross-sectional view showing when the regulating unit 170 shown in FIG. 4 opens the opening part. FIG. 7 is a conceptual view showing the load of the regulating unit shown in FIG. 4.

Referring to FIGS. 4 to 7, the regulating unit 170 includes a body portion 171 for opening and closing the opening part, an attachment portion 172 formed at one side of the body portion 171, and for attaching the detergent box 160 and the body portion 171, and a load portion or load 173 biased from the body portion 171, and for applying force to cause the body portion to close the opening part. The load portion 173 includes a load portion body 174 having first and second plates coupled to each other at a prescribed angle extending from the body portion 171 and a load producing portion or a prescribed amount of weight 175 arranged on the load portion body 174 and producing a load in the load direction.

The operation of the regulating unit 170 will be discussed. The user inserts the liquid detergent or the powdered detergent into the detergent storage unit 161. Once the liquid detergent or the powdered detergent is stored in the detergent storage unit 161, the liquid detergent or the powdered detergent applies force to the regulating unit 170. The loads ω1 and ω2 produced in the regulating unit 170 prevent the regulating unit 170 from being opened by the force. The load ω1 of the body portion 171 and the load ω2 of the load portion 173 are applied to one side of the engaging portion 172. The load ω1 of the body portion 171 and the load ω2 of the load portion 173 are applied to the same side of the engaging portion 172 to produce a moment. That is, a moment is produced clockwise by the load ω1 of the load portion 173. Also, a moment is produced clockwise by the load ω2 of the body portion 171. On the other hand, a moment is produced counterclockwise in the regulating unit 170 by the force applied from the powdered detergent. At this point, the sum of the moment produced by the load ω1 of the load portion 173 and the moment produced by the load ω2 of the body portion 171 is greater than the moment produced by the force applied from the powdered detergent or the liquid detergent. Accordingly, the regulating unit 170 is prevented from being opened due to the liquid detergent or the powdered detergent.

When washing water is supplied from the outside, the washing water is mixed with the liquid detergent or the powdered detergent and applies force to the regulating unit 170. The regulating unit 170 applies force to the regulating unit 170 by the pressure of the washing water. At this point, the sum of the moment produced by the load ω1 of the load portion 173 and the moment produced by the load ω2 of the body portion 171 is less than the moment produced by the force produced by the pressure of the washing water, the regulating unit 170 is opened. When the regulating unit 170 is opened, the washing water flows to the drum 122 and the tub. Accordingly, the user can use the liquid detergent or the powdered detergent without attaching a separate container to the detergent box 160. When the flow of the washing water to the drum 122 and the tub is completed, the regulating unit 170 closes the opening part by the loads ω1 and ω2.

The detergent box 160 includes a restraining wall for restraining the degree of rotation. The restraining wall 180 prevents the regulating unit 170 from being rotated at more than a predetermined angle. That is, when washing water is supplied from the outside and stored in the detergent storage unit 161, the regulating unit 170 is opened by the water pressure. At this point, the regulating unit 170 rotates counterclockwise. When the regulating unit 170 rotates at more than the predetermined angle, a moment is produced counterclockwise by the loads ω1 and ω2 produced in the regulating unit 170. Due to this moment, the regulating unit 170 is not able to close the opening part even after the washing water flows to the drum 122 and the tub. However, in the case that the restraining wall 180 is formed, the regulating unit 170 restrains the angle of rotation so as not to exceed the predetermined angle. That is, the restraining wall 180 restrains the load portion 173 during the rotation of the regulating unit 170 so that the load ω1 of the load portion 173 and the load ω2 of the body portion 171 are produced at one side of the engaging portion 172. Accordingly, the regulating unit 170 is not able to rotate at more than the predetermined angle because of the restraining wall 180. Also, once the flow of the washing water is completed, the regulating unit 170 closes the opening part by the loads ω1 and ω2.

The laundry processing device 100 is not limited to the foregoing description. The load ω1 of the load portion 173 and the load ω2 of the body portion 171 may be different. That is, the laundry processing device 100 may be configured such that the load ω2 of the body portion 171 is larger than the load ω1 of the load portion 173. In the case that the load ω2 of the body portion 171 is larger than the load ω1 of the load portion 173, a moment is produced by the loads ω1 and ω2 after the washing water flows to the drum 122 and the tub. That is, if the washing water is below a predetermined water level in the detergent storage unit 161, the regulating unit 170 rotates by the moment produced by the load ω2 of the body portion 171 and the moment produced by the load ω1 of the load portion 173. At this point, the moment produced by the load ω2 of the body portion 171 is larger than the moment produced by the load ω1 of the load portion 173, the regulating unit 170 rotates clockwise. Accordingly, once the low of the washing water is completed, the regulating unit 170 closes the opening part.

Figure 8:
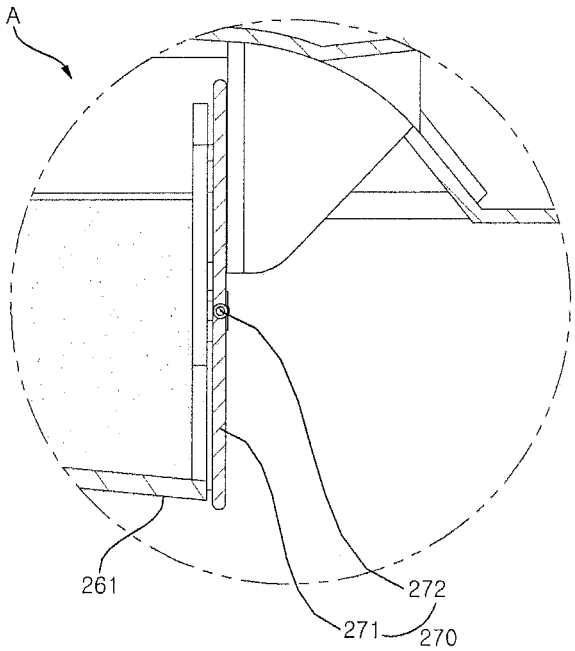
FIG. 8 is a cross-sectional view showing another embodiment of the regulating unit shown in FIG. 3.

FIG. 8 is a cross-sectional view showing another embodiment of the regulating unit 170 shown in FIG. 3. The same reference numerals same as those used in the first embodiment indicate the same members. In the following, a description will be given focusing on the differences between the previous embodiment and this embodiment.

Referring to FIG. 8, the regulating unit 270 includes a body portion 271 attached to one side of the detergent box 160 and an elastic portion 272 for producing an elastic force in the body portion 271 so as to resist the load of the liquid detergent or powdered detergent. The elastic portion 272 may include a spring for producing an elastic force in the body portion 271.

The operation of the regulating unit 270 will be discussed. The elastic portion 272 produces the elastic force so as to resist the load of the liquid detergent or powdered detergent. That is, when the user inserts the liquid detergent or the powdered detergent into the detergent storage unit 261, the body portion 271 closes the opening part by the elastic force. At this point, when washing water is supplied from the outside and poured into the detergent storage unit 261, the pressure of the washing water and the elastic force become equal when the water level of the washing water reaches a predetermined water level. When the water level of the washing water exceeds the predetermined water level, the water pressure becomes greater than the elastic force. As the pressure of the washing water is increased, the body portion 271 opens the opening part. Once the opening part is opened, the washing water flows to the drum 122 and the tub. When the supply of the washing water is stopped, water level of the washing water becomes lower than the predetermined water level. Once the water level of the washing water becomes lower than the predetermined water level, the pressure of the washing water becomes smaller than the elastic force and allows the body portion 271 to close the opening part. Accordingly, the user can use the liquid detergent or the powdered detergent without attaching a separate container to the detergent box 260. Moreover, the user benefits from an increased user convenience since there is no need to attach the container.

What is claimed is:

1. A laundry processing device comprising:

a detergent box to accommodate detergent and having a detergent storage well with a bottom surface and a rear wall, a bottom area of the rear wall having an opening;

a washing water supply device for supplying the detergent storage well with washing water from the outside; and a regulator configured to close the opening at the rear wall when less than a prescribed amount of washing water is provided in the detergent storage well by the washing water supply, and to open the opening the when the prescribed amount of washing water is reached in the detergent storage well, wherein the regulator includes:

a body plate for opening and closing the opening, the body plate have a bottom edge which extends beyond the bottom surface of the well in a closed position;

a load attached to the body plate, wherein a upper end of the body plate is attached to a lower end of the load and the upper end of the body plate and the lower end of the load are rotatably attached the rear wall of the detergent box above the opening, and wherein a rotation center of the regulator is positioned at the upper end of the body plate.

2. The laundry processing device of claim 1, wherein the body plate is opened by a pressure created by the prescribed amount of the washing water in the detergent storage well.

3. The laundry processing device of claim 2, wherein the load has a prescribed amount of weight.

4. The laundry processing device of claim 3, wherein the weight biases the body plate to close the opening.

5. The laundry processing device of claim 4, wherein the weight produces a moment to cause the body plate to close the opening.

6. The laundry processing device of claim 5, wherein the rear wall includes a restraining wall for restraining a degree of opening by the body plate.

7. The laundry processing device of claim 6, wherein the detergent is a liquid detergent or a powdered detergent.

8. The laundry processing device of claim 7, wherein the washing water supplied from the washing water supply device is mixed with the detergent in the detergent storage well, and the regulator is opened to allow the washing water to flow out through the opening.

9. The laundry processing device of claim 8, wherein the load includes a first plate attached to the body plate at a first prescribed angle such that the first plate extends toward a rear of the laundry processing apparatus.

10. The laundry processing device of claim 9, wherein the load further comprises a second plate attached to the first plate at a second prescribed angle such that the second plate extends toward a front of the laundry processing apparatus.

11. The laundry processing device of claim 10, wherein the first plate has a greater length than the second plate.

12. The laundry processing device of claim 10, wherein a prescribed amount of weight is attached to the second plate.

13. The laundry processing device of claim 12, wherein the prescribed amount of weight is provided by a shaft attached to the second plate.

14. The laundry processing device of claim 10, wherein the first and second prescribed angles are different from each other.

15. The laundry processing device of claim 10, wherein the load further comprises a third plate attached to the second plate at a third prescribed angle.

16. The laundry processing device of claim 15, wherein the third plate contacts the rear wall when a maximum degree of opening by the body plate is reached.

17. The laundry processing device of claim 16, wherein the rear wall further includes a retraining wall in which the third plate contacts.

18. The laundry processing device of claim 14, wherein the body plate is attached to the first plate at a prescribed angle such that the body plate extends toward a front of the laundry processing apparatus.

* * * * *